United States Patent [19]

Darmara

[11] Patent Number: 4,688,621

[45] Date of Patent: Aug. 25, 1987

[54] METHOD AND APPARATUS FOR CASTING RAPIDLY SOLIDIFIED INGOTS

[76] Inventor: Falih Darmara, Apt. 1 - Bloc C; Parc Guillemo, Andorra La Vella, Andorra

[21] Appl. No.: 873,303

[22] Filed: Jun. 9, 1986

Related U.S. Application Data

[63] Continuation of Ser. No. 594,289, Mar. 28, 1984, abandoned.

[51] Int. Cl.[4] ..... B22D 11/00

[52] U.S. Cl. ..... 164/46; 164/464; 164/474; 164/475; 164/479

[58] Field of Search ..... 164/464, 479, 421, 422, 164/429, 46, 114, 118, 286, 297, 474, 475; 264/8; 425/8

[56] References Cited

U.S. PATENT DOCUMENTS

| | | | |
|---|---|---|---|
| 1,479,629 | 1/1924 | Sicard . | |
| 2,450,832 | 10/1948 | Kuhlman . | |
| 3,174,221 | 3/1965 | Blair . | |
| 3,670,400 | 6/1972 | Singer | 164/475 |
| 3,941,181 | 3/1976 | Stoody . | |
| 4,073,336 | 2/1978 | Roe et al. . | |
| 4,217,082 | 8/1980 | Bourdeau | 425/8 |
| 4,259,270 | 3/1981 | Winter et al. . | |
| 4,512,384 | 4/1985 | Sendzimir | 164/46 |

FOREIGN PATENT DOCUMENTS

| | | | |
|---|---|---|---|
| 2528843 | 1/1976 | Fed. Rep. of Germany | 164/46 |
| 656739 | 4/1979 | U.S.S.R. | 164/46 |

*Primary Examiner*—Kuang Y. Lin
*Attorney, Agent, or Firm*—Bacon & Thomas

[57] ABSTRACT

A method and apparatus for casting rapidly solidified metal ingots wherein molten metal is centrifugally formed into molten droplets that are rapidly solidified under controlled conditions into metal particles which are cast against a rotating mold cavity within which the metal particles are consolidated into an ingot to be subsequently worked to a billet.

7 Claims, 5 Drawing Figures

METHOD AND APPARATUS FOR CASTING RAPIDLY SOLIDIFIED INGOTS

This application is a continuation of application Ser. No. 594,289, filed Mar. 28, 1984, now abandoned.

BACKGROUND OF THE INVENTION

1. Field of the Invention

The present invention generally involves the field of technology pertaining to the centrifugal casting of metals. More particularly, the invention relates to an improved method and apparatus for making metal ingots intended for subsequent hot forging.

2. Description of the Prior Art

It is known to be desirable for cast metal ingots to be subsequently worked, such as hot working process by forging, for the purpose of imparting desirable strength and other structural properties to such ingots. Any subsequent working of the ingot is greatly facilitated if the ingot has been cast with a fine grain and close interdendritic structure. By contrast, ingots having a large grain structure and coarse interdendritic spacing are difficult to work and require additional process steps which are costly in terms of both energy and time.

It is further known that the production of close interdendritic spacing in cast metals requires that the molten metal stock be subjected to rapid solidification, thereby producing a metal crystalline structure characterized by close interdendritic spacing, little microsegregation and extremely fine precipitate size. However, known techniques for producing metal ingots and billets through rapid solidification are generally quite limited in application and use since such techniques are both costly and inefficient.

It is known to make a billet having the above mentioned desirable properties according to conventional techniques. For example, the metal is reduced to powder of very small particle size and thereafter rapidly cooled, either by high pressure inert gas or by impinging the powder onto the cooled copper metal heat sink. Another known method involves casting the metal against the metal sink to form a very thin sheet or ribbon of the metal, which is subsequently ground to make a powder thereof. In either case, the resulting metal powder must be compressed in a container, commonly called a "can". This can, together with its contents, must then be consolidated through hot isostatic pressing and/or extruding. Subsequently, the can must be removed and the billet thus obtained is ready for further hot working. For metals containing strong nitride or oxide formers, most or all of the aforedescribed operations must be carried out in the absence of air, such as within a noble gas atmosphere or vacuum protection. It is easily seen that presently available techniques for the production of billets possessing the greatly enhanced properties imparted by rapidly solidified metals and alloys are cumbersome, time consuming and extremely expensive.

There is presently an urgent need for an economical and efficient method of producing reforging metal stock with enhanced metallurgical properties resulting from rapid solidification.

SUMMARY OF THE INVENTION

It is an object of the present invention to provide an improved method and apparatus for casting a metal ingot intended to be subsequently worked into a billet.

It is another object of the invention to provide a method and apparatus for producing metal billets having extremely close interdendritic spacing, lack of segregation, fine precipitate size and fine grain size.

It is a further object of the invention to provide an efficient and economical system for casting rapidly solidified metal ingots in essentially a single step operation.

These and other objects of the invention are realized through an improved method and apparatus for the centrifugal casting of a molten metal stock within a vacuum chamber environment. The molten metal is metered into a spinning crucible provided with a tapered substantially cylindrical-shaped cavity from which the molten metal is thereafter ejected into the form of metal droplets. The metal droplets undergo rapid solidification to metal droplets having a temperature just below the solidification temperature of the metal, at which point the metal particles are consolidated within the cavity of a rotating mold disposed peripherally of the spinning crucible. The rate of solidification may be precisely controlled by varying the degree of vacuum within the chamber. The spinning crucible is supported for vertical movement to provide an even distribution and consolidation of the metal particles within the mold. The tapered configuration of the cavity within the spinning crucible is such that the cavity converges towards its opening, thereby permitting a layer of molten metal to constantly remain along the vertical wall surface in order to assure that the speed of the molten metal ejected from the crucible is substantially the same as the peripheral speed of the crucible.

In a preferred apparatus of the invention, the mold is essentially of a ring-shaped configuration and supported by horizontal and vertical needle bearings for rotation about a common axis of rotation with the spinning crucible. The lower portion of the mold is provided with ring gear that is engaged by a motor driven pinion gear. The spinning crucible is supported for vertical movement by a fluid operated jack and also carries a ring gear for engagement by a motor driven pinion gear. The entire apparatus is enclosed within a vacuum chamber which may be evacuated as desired, and a gas inlet is also preferably provided to permit the introduction of a desired gas for controlling the atmosphere within the chamber.

Other objects, features and advantages of the invention shall be apparent from the following detailed description of preferred embodiments thereof, with reference to the accompanying drawings which form a part of this specification, wherein like reference characters designate corresponding parts of the several views.

DETAILED DESCRIPTION OF THE PREFERRED EMBODIMENTS

Figure 1:
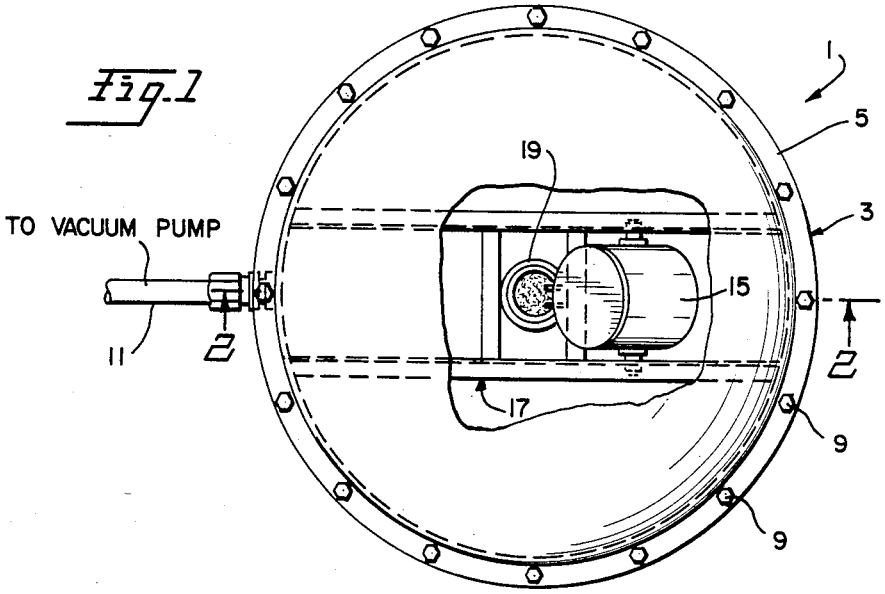
FIG. 1 is a plan view partly broken away, of a preferred embodiment of an apparatus for use in the practice of the present invention.

The casting of molten metal in a mold to produce an ingot thereof involves utilizing the mold itself for extracting heat from the melt in order to permit the initiation of solidification. Since the melt is usually poured into the mold at a temperature of 75°–175° F. above the melting point of the metal, sufficient heat has to be extracted in order to bring the temperature of the melt down towards the solidification point and the heat of fusion must be extracted before actual solidification occurs. As is therefore apparent, the heat has to be removed through the mold body and distributed to the ambient surroundings. The melt in immediate contact with the mold shall solidify first and shrink, with such solidification being accompanied by the rejection of solute to the remaining molten metal. The rate and quantity of the amount of solute rejected are dependent on the phase diagram of the specific metal alloy. This serves to establish a temperature and segregation gradient within the metal, with segregation being defined as the concentration of alloying elements at specific regions resulting from primary crystallization of one phase, with the subsequent concentration of other elements in the remaining liquid. Therefore, the segregation problem increases with increase in the size of the billet being cast, increase in the complexity of the alloy system and decrease in the heat conductivity of the molten metal. Since the interdendritic spacing of dendrite crystals formed by solidification is adversely proportional to the solidification rate, such spacing shall be large and accompanied by proportional increase in grain size when the rate of solidification is slow. The undersirable characteristics of billets produced in molds through minimum or reduced rates of solidification are therefore large grain size, large interdendritic spacing and a high degree of segregation. Such ingots require a costly operation for subsequent hot working into final products of desired strength and structural properties, a disadvantage not associated with cast ingots having a close interdendritic spacing and fine grain structure.

It has been discovered that the solidification rate of a molten metal alloy can be increased by several orders of magnitude, the aforedescribed undersirable characteristics resulting from a slow rate of solidification can be eliminated, and the resulting properties of the solidified product would be advantageously enhanced.

The most obvious way of realizing a rapid rate of solidification would be to cast ingots of minimum size and under conditions wherein the fastest extraction of the heat of fusion can be accomplished. For example, metal particles can be formed and thereafter rapidly cooled by contacting the billets with a blast of high heat conductivity gas. Metal powders made according to this technique are known as Rapid Solidified Particles or RSP powders. Through the practice of this technique, solidification rates as high as $10^{6°}$ F./second have been obtained. Articles made from these RSP powders, particularly powders of high temperature alloys, have exhibited good properties. Moreover, the application of this technique has expanded to other alloy systems, including complex aluminum alloys. However, this technique, in actual commercial practice, is extremely unwieldy and costly. The alloy must first be made into a powder, while maintained under vacuum, screened under vacuum or inert gas, placed into a metal can, evacuated of any gas, welded under vacuum, heated to forging temperature, extruded in a special press, decanned, inspected, cut into increments and forged to the final product.

The present invention therefore provides a greatly improved method and apparatus through which metal ingots having the properties of RSP powder products may be efficiently and economically cast through what is essentially a single stage operation.

A preferred apparatus for practicing the invention shall now be described with reference to FIGS. 1–4 of the drawings. As particularly shown in FIGS. 1 and 2, an apparatus 1 includes a vacuum chamber 3 defined by a top section 5 that is removably attached to a base section 7 through a plurality of spaced nut and bolt assemblies 9. Chamber 3 is provided with an outlet 11 for connection to a vacuum pump (not shown) and an inlet 13 for connection to a gas source (not shown), such as an inert gas, including argon or the like.

Figure 3:
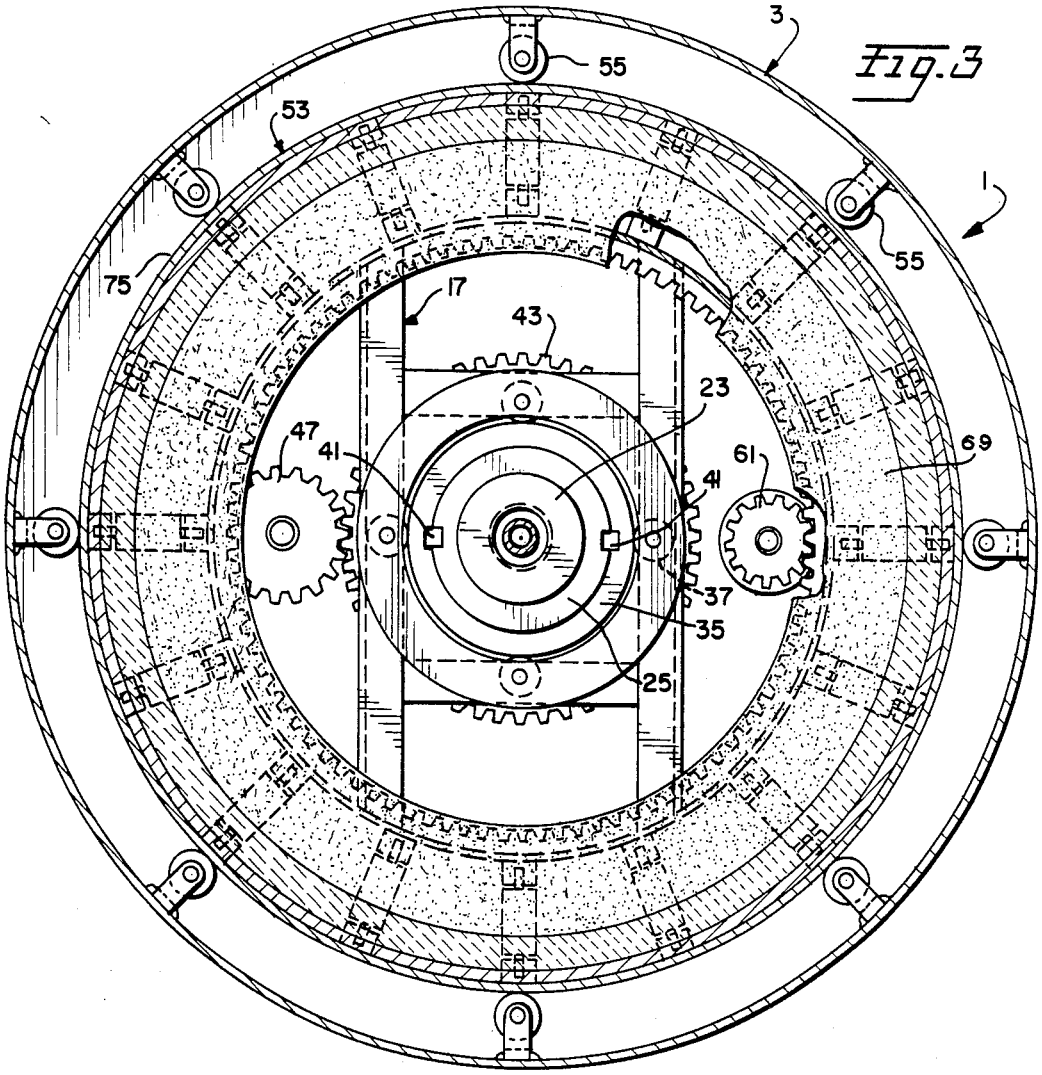
FIG. 3 is a horizontal sectional view, taken on the line 3—3 of FIG. 2.
Figure 4:
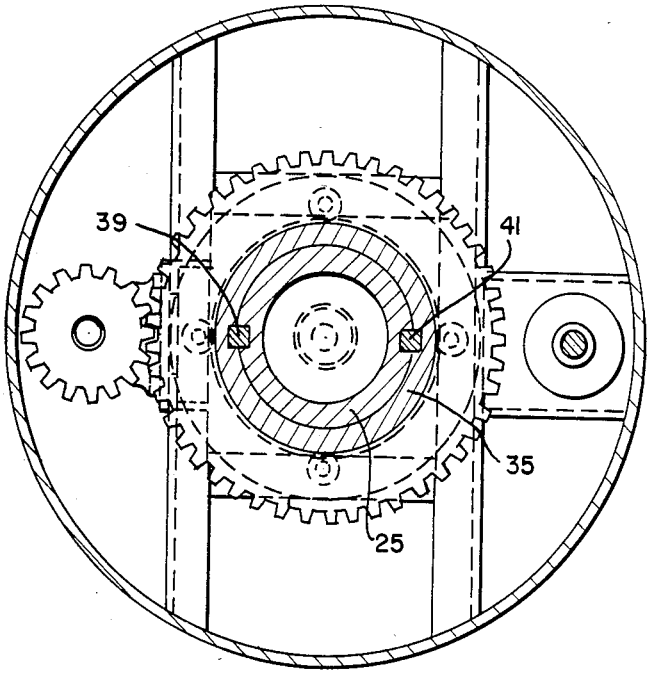
FIG. 4 is a horizontal sectional view, partly broken away, taken on the line 4—4 of FIG. 2.

A melting crucible 15 is disposed within chamber 3 and supported for pivotal movement on a rail frame 17. A transfer crucible 19 is also carried by frame 17 for receiving molten metal 21 from crucible 15 and metering same into a spinning crucible 23, the latter depicted in FIG. 2 in two different vertical positions. As also shown therein, crucible 23 is secured within a sleeve 25 that is supported at the upper end of a piston rod 27, the latter forming a portion of a fluid jack assembly 29. Assembly 29 includes a pair of appropriate fluid inlet and outlet openings 31 and 33, respectively, through which gaseous or hydraulic fluids may be introduced and removed for the purpose of raising and lowering piston 27, thereby imparting corresponding vertical movement to crucible 23. Sleeve 25 is further secured within an outer casing 35 which is supported for rotation in a stationary position by a plurality of upper needle bearings 37 and lower needle bearings 39. With particular reference to FIGS. 3 and 4, sleeve 25 is slidably secured within casing 35 by a pair of opposed keys 41 which permit sleeve 25 to move vertically but not rotate with respect to casing 35. Accordingly, rotation of casing 35 shall cause concurrent rotation of sleeve 25, with the latter also capable of being raised and lowered relative to casing 35 through the action of jack assembly 29.

The rotation of casing 35 is accomplished by providing a ring gear 43 on the outer periphery of casing 35. A motor 45, including a pinion gear 47 connected to the end of a drive shaft 49, is disposed in the lower portion of chamber 3 adjacent ring gear 43. Pinion gear 47 and ring gear 43 are placed in meshed engagement so that operation of motor 45 shall cause casing 35 to rotate. It is preferred that motor 45 be rigidly supported on a framework 51 which also provides support for needle bearings 39.

A circular-shaped mold 53 is supported for rotation spaced from and about the periphery of spinning crucible 23 by a plurality of vertical needle bearings 55 and a plurality of horizontal needle bearings 57. The lower portion of mold 53 is provided with a ring gear 59 which is disposed in meshed engagement with a pinion gear 61 carried at the end of a drive shaft 63 of a motor 65. It is also preferable that motor 65 be rigidly supported on framework 51. Mold 53 is provided with a detachable top portion 67 to permit removal of a metal ingot 69 cast therein. It is also preferable that mold 53 be provided with an outer metal casing 71 and an inner liner 73, the latter being of an appropriate heat insulating material. The outer peripheral surface of mold 53 may be provided with a circumferential bearing plate 75 for engagement by vertical needle bearings 55. Similarly, an annular bearing plate 77 may be provided at the bottom of mold 53 for engagement by horizontal needle bearings 57.

Figure 5:
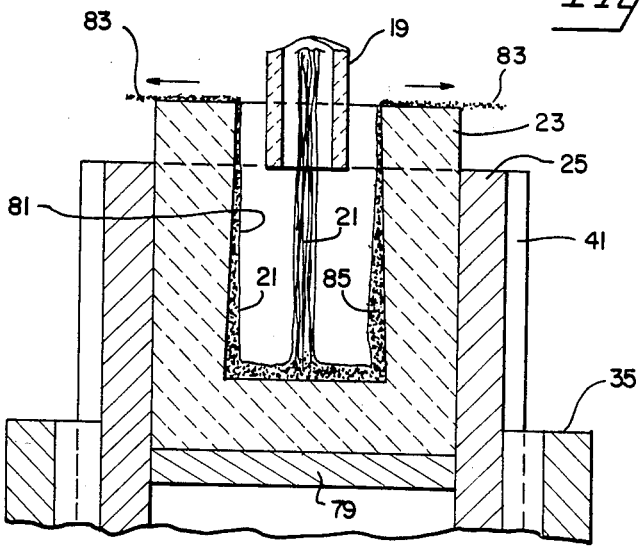
FIG. 5 is an enlarged fragmentary vertical sectional view of the spinning crucible utilized in the apparatus of FIG. 1.

The preferred configuration of spinning crucible 23 shall now be described in detail with particular reference to FIG. 5. As shown therein, crucible 23 is of a substantially cylindrical configuration and supported at the upper end of sleeve 25 for rotation therewith. A bottom plate 79 is rigidly attached to sleeve 25 for engagement with the bottom of crucible 23. It is preferable that crucible 23 be removably secured within sleeve 25 for maintenance of replacement. Crucible 23 is provided with an open cavity 81 for receiving molten metal 21 from metering crucible 19. Cavity 81 is substantially cylindrical in configuration but diverges from its bottom towards its opening at the top of crucible 23. Because of this configuration, when molten metal 21 is metered into rotating crucible 23 from transfer crucible 19, it first impacts against the bottom of cavity 81 and is diverted radially outwardly against the vertical wall of cavity 81. Because of the centrifugal force generated, molten metal 21 then climbs upwarely along the vertical wall of cavity 81 towards its opening from which it is then ejected radially and outwardly therefrom towards the cavity of mold 53. This is depicted in FIG. 5 wherein molten metal 21 is centrifugally ejected radially outwardly and formed into molten metal droplets 83 which undergo rapid solidification to metal particles that are consolidated within mold 53 to form metal ingot 69. It is important to note from FIG. 5 that molten metal 21 accumulates and moves along the vertical wall of cavity 81 as a constant layer 85 which is continually replenished with molten metal 21 from metering crucible 19. Layer 85 assumes the general configuration defined by the vertical wall of cavity 81 and decreases in thickness from the bottom of cavity 81 towards its top opening. This configuration of cavity 81 and the resulting layer 85 of molten metal created thereby assures that molten metal 21 being centrifugally ejected outwardly from the opening of cavity 81 is at the same peripheral speed as that of crucible 23.

MODE OF OPERATION

Figure 2:
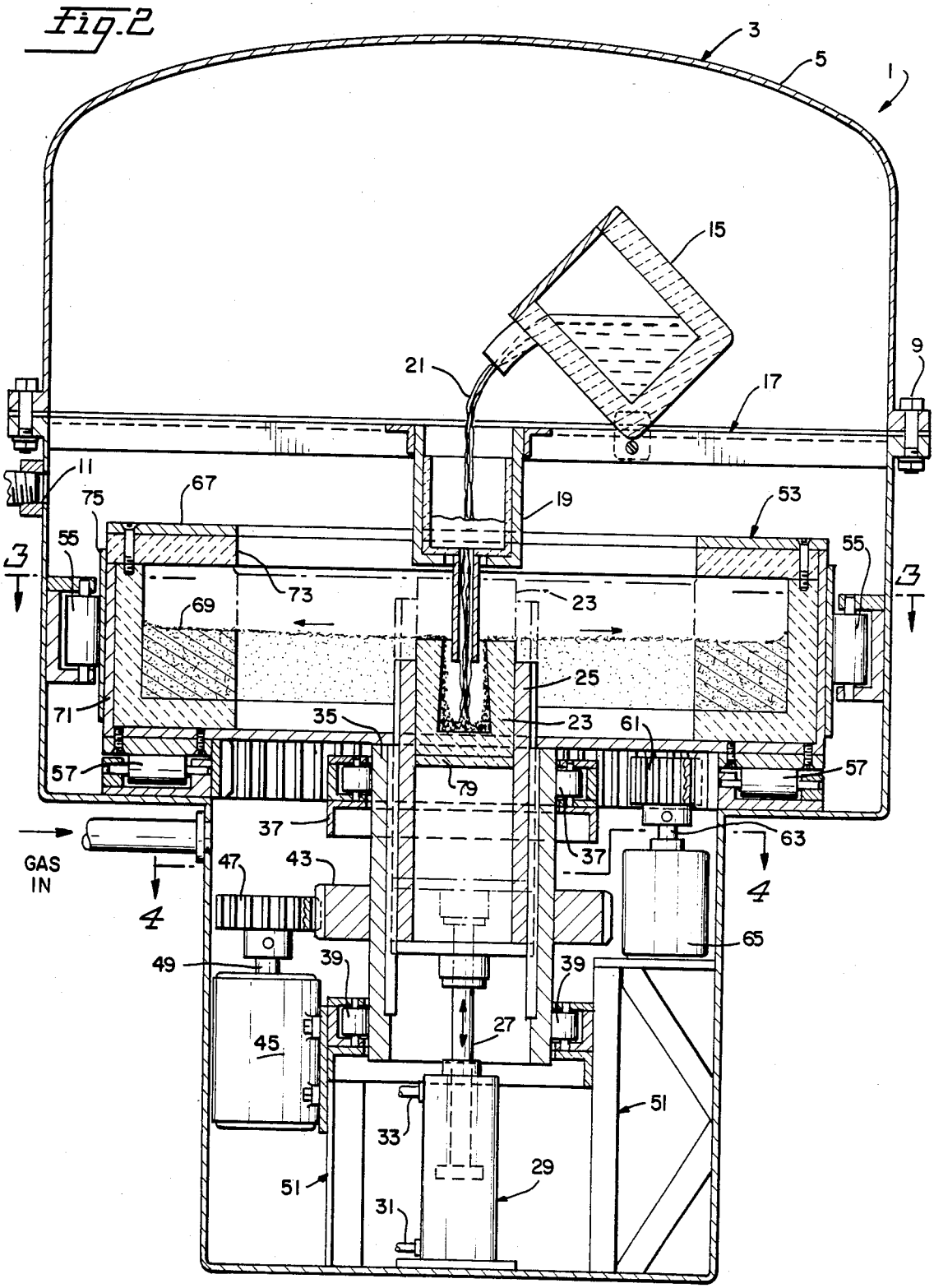
FIG. 2 is an enlarged vertical sectional view, taken on the line 2—2 of FIG. 1.

A preferred method for practicing the invention shall now be described with reference to preferred apparatus 1 shown in the drawings, particularly as depicted in FIGS. 2 and 5. The metal or alloy thereof desired to be cast into ingot 69 is first placed within melting crucible 15 and heated therein to its molten state. Jack assembly 29 is then activated to place spinning crucible 23 in its desired initial position, usually at its uppermost or lowermost position. Motors 45 and 65 are then actuated for the purpose of imparting rotational movement to spinning crucible 23 and mold 53, respectively, in either the same or opposite directions. Molten metal 21 produced in crucible 15 is then poured into metering crucible 19 which serves to meter or dispense molten metal 21 into spinning crucible 23 at the desired rate. It is understood that melting crucible 15 and metering crucible 19 may comprise any such structures well known in the art and capable of performing the functions required for the practice of this invention.

Molten metal 21 being fed into spinning crucible 23 impacts against the bottom of cavity 81 and is immediately ejected outwardly against the vertical wall of cavity 81, along which it climbs upwardly and maintains a constant layer 85 thereagainst. Molten metal 21 is thereafter ejected out of the opening of cavity 81 in a direction extending radially from the axis of rotation of spinning crucible 23. At this point, the speed of rotation of crucible 23 is at a rate sufficient to cause molten metal 21 to immediately separate into the form of molten droplets 83 which are directed against the cavity of mold 53.

Molten droplets 83 undergo rapid solidification over the distance from their point of ejection from spinning crucible 23 and their point of consolidation within mold 53 to form ingot 69. In order to provide a uniform accumulation of solidified molten droplets 83 within the cavity of mold 53, jack assembly 29 is actuated to raise or lower spinning crucible 23 so that an even layer of solidified metal particles can be continuously laid and consolidated within revolving mold 53.

The rapid solidification of molten droplets 83 to their corresponding metal particles produces a crystalline structure characterized by very close interdendritic spacing, minimized segregation and very fine grain configuration. It is important to note that molten droplets 83 are cooled to their solidification point during their travel from spinning crucible 23 to the interior of mold 53. Consolidation of the resulting metal particles is accomplished when they impact against the wall of mold 53 by the centrifugal force generated through rotation of mold 53. Therefore, the optimum temperature for consolidation should be such as to maintain molten droplets 83 in a solidified state, but as close as possible to the melting point of the metal. Since this optimum temperature is quite high, the metal particles resulting from the solidification of molten droplets 83 are structurally weak so that the centrifugal force imparted by rotating mold 53 effectively functions to consolidate such particles that they are impacted against the wall of the mold 53.

It should be noted that the benefits conferred by rapid solidification occurs precisely because the solidification is rapid and not because the rate of cooling to room temperature is rapid. Thus, if it were possible to cool the metal slowly to the freezing point, rapidly solidify the metal and thereafter maintain the temperature just below the freezing point, the properties of the metal realized would be the same, if not better, than those of a particle that had been cooled rapidly from the melt temperature to room temperature. Prior to the present invention, there has been no method capable of controlling the solidification rate independently of the general continuous cooling rate. Since the control of the solidification rate is an important aspect of the invention, the method by which this is accomplished shall hereinafter be detailed.

Molten metal 21 is initially dispensed at a controlled rate into spinning crucible 23. The metal is caused to be ejected from the peripheral lip of crucible 23 in the form of a thin sheet which is radially directed and subsequently breaks up into molten metal droplets 83 which in turn travel the distance from the lip of crucible 23 to the interior casting wall of rotating mold 53. Droplets 83 undergo solidification over their distance of travel to mold 53 and form metal particles that accumulate within mold 53 and are compressed against the interior wall thereof by virtue of the centrifugal force generated.

The temperature of molten metal 21 being dispensed within crucible 23 may be easily controlled by any conventional means well known in the art. The temperature of molten metal 21 and the rate at which it is dispensed within crucible 23 serve to collectively determine the exit temperature of molten metal 21 at the lip of crucible 23, after steady state of the process has been attained.

Since the rate at which molten metal 21 is dispensed into crucible 23 can be maintained constant and the incoming temperature of molten metal 21 can be controlled, the exit temperature of molten metal 21 being ejected from crucible 23 can also be held constant. This exit temperature ($T_1$) shall depend on several factors, including the nature of the metal or alloy being cast, the size of crucible 23, the speed at which crucible 23 is rotated, etc., and has to be determined emperically. $T_1$ shall generally be at a level that is significantly higher than the freezing point of the metal.

The cooling of molten metal droplets 83 in order to achieve as rapid a solidification as possible occurs over the distance traveled from the lip of crucible 23 at $T_1$ to the interior wall of mold 53, at which latter point the resulting metal particles are at the desired terminal temperature ($T_2$). The cooling from $T_1$ to $T_2$ is controlled by two main factors, radiation cooling and aerodynamic cooling. During the cooling procedure, molten metal 21 is broken up into molten metal droplets 83 which in turn undergo solidification into their corresponding metal particles. The size of the resulting metal particles depends on several factors, including the speed of travel, the aerodynamic drag and the viscosity of the metal. It should be noted that the size of the metal particles shall comprise a gaussian distribution around a mean size ($S_m$).

The radiation component of the heat loss of the metal particles is determined by the law governing radiation losses. As is known, radiation losses increase as the fourth power of the radiating temperature. Since molten metal 21 at $T_1$ is close to 1700° K., the radiation loss per surface area of each molten metal droplet 83 is very high. Accordingly, as the size of molten metal droplets 83 decrease, the surface to volume, and hence to weight, ratio increases significantly. It can be seen that molten metal droplets 83 shall cool rapidly by radiation loss during the transit time from the lip of crucible 23 to the interior wall of mold 53. This transit time shall depend on the exit velocity of molten metal droplets 83 from crucible 23, and also the size of the apparatus which necessarily determines the distance from the lip of crucible 23 to the interior wall of mold 53. Furthermore, the emissivity of the metal particles which determines their ability to radiate is impossible to estimate apriority. Therefore, another element of control must be introduced to the system in order to establish the desired $T_2$.

For particles of size $S_m$, the radiation losses will be practically constant. However, this may not necessarily be sufficient to extract sufficient heat to bring the temperature from $T_1$ to $T_2$ and effect the desired degree of rapid solidification. Therefore, the present invention envisions a controllable method of additional heat extraction through aerodynamic cooling. Under vacuum conditions, i.e. at pressures of up to 500 microns, aerodynamic cooling is negligible. However, as the pressure rises into the millimeters of mercury or more range, aerodynamic cooling becomes increasingly more effective. Thus, by modulating the pressure within vacuum chamber 3, the heat extraction for effecting rapid solidification can be effected and varied from pure radiation to essentially entirely aerodynamic. Pressure modulation within chamber 3 can be easily accomplished by controlling the pumping rate of the vacuum pump (not shown) through outlet 11 and the rate at which gas is emitted through inlet 13. These factors serve to establish a steady state equilibrium to provide the most effective rate of rapid solidification of molten metal droplets 83 in the practice of the invention.

Another advantage of this method of pressure control is to maintain the ambient temperature within vacuum chamber 3 at a constant level. As is apparent, a great deal of heat is extracted due to the freezing of molten metal particles 83, and this heat must be removed or else the ambient temperature in chamber 3 will rise, thereby rendering it difficult to control the cooling rate. Therefore, by continuously injecting gas through inlet 13 into chamber 3, and continuously removing the gas through outlet 11 by the vacuum pump (not shown), the heat extracted during solidification of molten metal droplets 83 is continuously removed. The heated gas exiting from outlet 11 can either be exhausted to the atmosphere or, more economically, recirculate it into chamber 3 through inlet 13 after being cooled through a heat exchanger. Cooling gas fed into chamber 3 through inlet 13 may include helium, argon, hydrogen or any other suitable gas deemed appropriate to cool and protect the solidified metal particles generated by rotating crucible 23. In the event it is desirable to form oxide or nitride dispersion strengthened particles, the cooling gas can be inoculated with the required degree of oxygen or nitrogen.

The aforedescribed method of cooling molten metal droplets 83 from $T_1$ to $T_2$ may be accomplished in an automated manner. This can be realized by citing a temperature sensing device on the wall of mold 53, with such device functioning to operate a valve (not shown) on gas inlet 13, thereby increasing or decreasing the amount of gas entering into chamber 3. In this way, the cooling rate of molten metal droplets 83 to $T_2$ can be precisely controlled.

The optimum temperature of $T_2$ would be that at which the metal particles of size $S_m$ have been completely solidified, i.e. the heat of fusion being completely removed but the particles not having been significantly cooled. At this state, the particle interdendritic spacing would have been established, but the strength of the metal would be at its lowest so that the centrifugal force generated on the rotating wall of mold 53 would be highly effective in compacting the solidified particles together to accumulate and form ingot 69. However, since the size of the metal particles is not uniform, but is instead a gaussian distribution around a mean size $S_m$, particles of size $S_m$ shall be at the optimum temperature $T_2$. Particles small than $S_m$ shall be at a temperature less than $T_2$ and particles larger than $S_m$ shall be at a temperature greater than $T_2$, the larger particles still retaining some heat of fusion. In practice of the invention, there shall be realized a rapid heat transfer so that the smaller colder particles extract sufficient heat to solidify the still molten metal droplets 83. $T_2$ should be as high as possible, but low enough so that total solidification is achieved quickly in the mass of metal particles accumulated in centrifugal mold 53. Once solidification of molten metal droplets 83 has been realized and the metal particles resulting therefrom has accumulated to form ingot 69 in mold 53, enhanced densification of ingots 69 is realized if the particles are maintained at a temperature as close to the solidification point as possible. In order to accomplish this objective, mold 53 is preferably provided with an inner lining of an insulating material, such as hard brick. To prevent adherence of the solidified metal particles to the lining and facilitate removal of ingot 69, the exposed face of the lining may be provided with a disposable thin metal sheathing.

In the formation of ingot 69, it is not necessary to achieve 100% densification since ingot 69 comprises an intermediary product having a fine grain structure which is intended for subsequent working, such as hot forging or rolling. It is only necessary that the densification be sufficient so as to eliminate interconnecting pores within ingot 69 in order to permit subsequent heating of ingot 69 in an ordinary forging furnace.

In order to provide an even distribution of metal particles within mold 53, crucible 23 is raised or lowered by the action of jack assembly 29. There are essentially two methods for accomplishing this objective. First, crucible 23 may be moved in one direction only, either upwardly or downwardly, and very slowly as the final thickness of ingot 69 is accumulated within mold 53. Alternatively, crucible 23 may be reciprocated upwardly or downwardly so that the metal particles are consolidated against the surface of mold 53 in alternating layers. After mold 53 has been filled with metal particles to define ingot 69, the flow of molten metal 21 into crucible 23 is terminated. After an appropriate length of time, rotation of mold 53 is also terminated. Thereafter, top section 5 of chamber 3 may be removed to permit access to mold 53. Top portion 67 of mold 53 is then removed to permit removal of ingot 69. Ingot 69 may thereafter be worked either immediately or after cooling and reheating. The working can be accomplished either by a ring roller or in a press or rolling mill after ingot 69 has been cut into plural segments.

As an example of the present invention, crucible 23 may be provided with a cavity 81 having an eight inch diameter opening and rotated at 8000 rpm, thereby resulting in a peripheral speed of about 250 feet per second. The stream of molten metal 21 being centrifugally ejected from crucible 23 at the latter speed shall break up into molten droplets 83, the size of which shall be a gaussian distribution around a mean size. If the circumferential wall of mold 53 is four feet in diameter, the distance traversed by droplets 83 is 1.6667 feet and the time to travel this distance shall be about 0.007 seconds. Therefore, droplets 83 must undergo solidification within this time and distance limit. Assuming a mean droplet diameter of 100 microns, a mean solidification rate of approximately $10^{4}$° F./second would be realized. With proper manipulation of the parameters involved, solidification rates an order of magnitude higher can be achieved.

While the invention has been described and illustrated with reference to certain preferred embodiments and operating parameters, it shall be appreciated that various modifications, changes, additions, omissions and substitutions may be resorted to by those skilled in the art and considered to be within the spirit and scope of the invention and appended claims.

I claim:

1. A method for casting an ingot of a metal having a structure characterized by close interdendritic spacing, minimum segregation and having enhanced properties realized through rapid solidification of the meal being cast, comprising the steps of:

(a) confining a source of molten metal, a vertically oriented crucible having an open substantially cylindrical cavity, and a rotatable mold having a cylindrical casting surface within a pressurizable airtight chamber;

(b) metering the molten metal into the cylindrical cavity of the crucible;

(c) rotating the crucible to cause the molten metal to climb upwardly along the wall of the cavity and be ejected radially and outwardly therefrom in the form of molten metal droplets;

(d) controlling the pressure within the chamber so as to cause substantially all of the ejected molten metal droplets to be rapidly solidified into solid metal particles having a casting temperature of just below the melting temperature of the metal; and (e) casting the solid metal particles while at the casting temperature against the casting surface of the mold during rotation of same whereby the centrifugal force generated by the rotation of the mold consolidates the solid metal particles into an ingot of circular configuration.

2. The method of claim 1 further including the step of rotating the crucible and the mold about a common axis of rotation.

3. The method of claim 2 further including the step of rotating the crucible and the mold in opposite directions.

4. The method of claim 2 further including the step of rotating the crucible and the mold in the same direction.

5. The method of claim 1 further including the step of moving the crucible vertically to provide a uniform consolidation of the solid metal particles against the casting surface of the mold.

6. The method of claim 1 wherein the step of controlling the pressure within the chamber includes varying the degree of vacuum in the chamber to control the rate of solidification of the ejected molten metal droplets.

7. The method of claim 1 wherein the step of controlling the pressure within the chamber includes introducing a gas into the chamber to control the rate of solidification of the ejected molten metal droplets.

* * * * *